US005984307A

United States Patent [19]

Fontana

[11] Patent Number: 5,984,307

[45] **Date of Patent: *Nov. 16, 1999**

[54] METHOD FOR PLAYING BOARD GAME

[76] Inventor: William R. Fontana, 2204 Stonewood Ct., San Pedro, Calif. 90732

[ * ] Notice: Under 35 U.S.C. 154(b), the term of this patent shall be extended for 639 days.

[21] Appl. No.: 08/585,472

[22] Filed: Jan. 16, 1996

Related U.S. Application Data

[60] Division of application No. 08/338,045, Nov. 14, 1994, which is a continuation-in-part of application No. 08/182,229, Jan. 18, 1994, abandoned.

[51] Int. Cl.[6] ..... A63F 3/00; A63F 3/02

[52] U.S. Cl. ..... 273/255; 273/262

[58] Field of Search ..... 273/255, 262

[56] References Cited

U.S. PATENT DOCUMENTS 4,982,965 1/1991 Dozorsky ..... 273/262

FOREIGN PATENT DOCUMENTS 904669 11/1945 France ..... 273/255

*Primary Examiner*—Benjamin H. Layno

*Attorney, Agent, or Firm*—Irving Keschner

[57] ABSTRACT

A war game device comprising a playing board having a plurality of squares thereon, preferably ten squares long and thirteen squares wide. Playing pieces are provided to each player, the pieces representing a command post (one for each player), infantry battalions (three for each player), tank battalions (four for each player), and armored battalions (four for each player), for movement among the squares in the accordance with the call of a device and game instructions. The object of the game is for one player to "capture" the command post token of the other player, the command post token occupying a stationary position on the board and thus being unable to move to escape being captured.

6 Claims, 2 Drawing Sheets

METHOD FOR PLAYING BOARD GAME

RELATED APPLICATIONS

This application is a divisional of application Ser. No. 08/338,045 filed Nov. 14, 1994, which is a continuation-in-part of application Ser. No. 08/182,229 filed Jan. 18, 1994, now abandoned.

BACKGROUND OF THE INVENTION

1. Field of the Invention

The present invention relates to a board game device which combines the skill features of chess with the excitement of a game simulating military maneuvers.

2. Description of the Prior Art

A number of board games have been available in the prior art, particularly those which move players' pieces to areas of the board in accordance with the call of a die and game instructions. For example, the game of Monopoly utilizes the movement of players' pieces along sequential squares formed adjacent the edges of the board. U.S. Pat. No. 4,323,249 to Brady discloses a board game which utilizes game pieces, dice and a "driving" track around the center of the board, the game board providing education for players in defensive driving skills in traffic situations.

What is desired is to provide a board game device which conveys a sense of military maneuvering which at the same time utilizing some of the movements associated with the game of chess.

SUMMARY OF THE PRESENT INVENTION

The present invention provides a war game device comprising a playing board having a plurality of squares thereon, preferably ten squares long and thirteen squares wide. Playing pieces are provided to each player, the pieces representing a command post (one for each player), infantry battalions (three for each player), tank battalions (four for each player), and armored battalions (four for each player), for movement among the squares in the accordance with the call of a device and game instructions. The object of the game is for one player to "capture" the command post token of the other player, the command post token occupying a stationary position on the board and thus being unable to move to escape being captured.

The present invention thus provides a simple, inexpensive board game which combines the intellectual skills required in chess with the public interest in things military. The game can be miniaturized so that it can be conveniently stored and played in automobiles, airplanes, etc.

BRIEF DESCRIPTION OF THE DRAWINGS

For a better understanding of the invention as well as other objects and further features thereof, reference is made to the following description which is to be read in conjunction with the accompanying drawing wherein.

DESCRIPTION OF THE INVENTION

Figure 1:
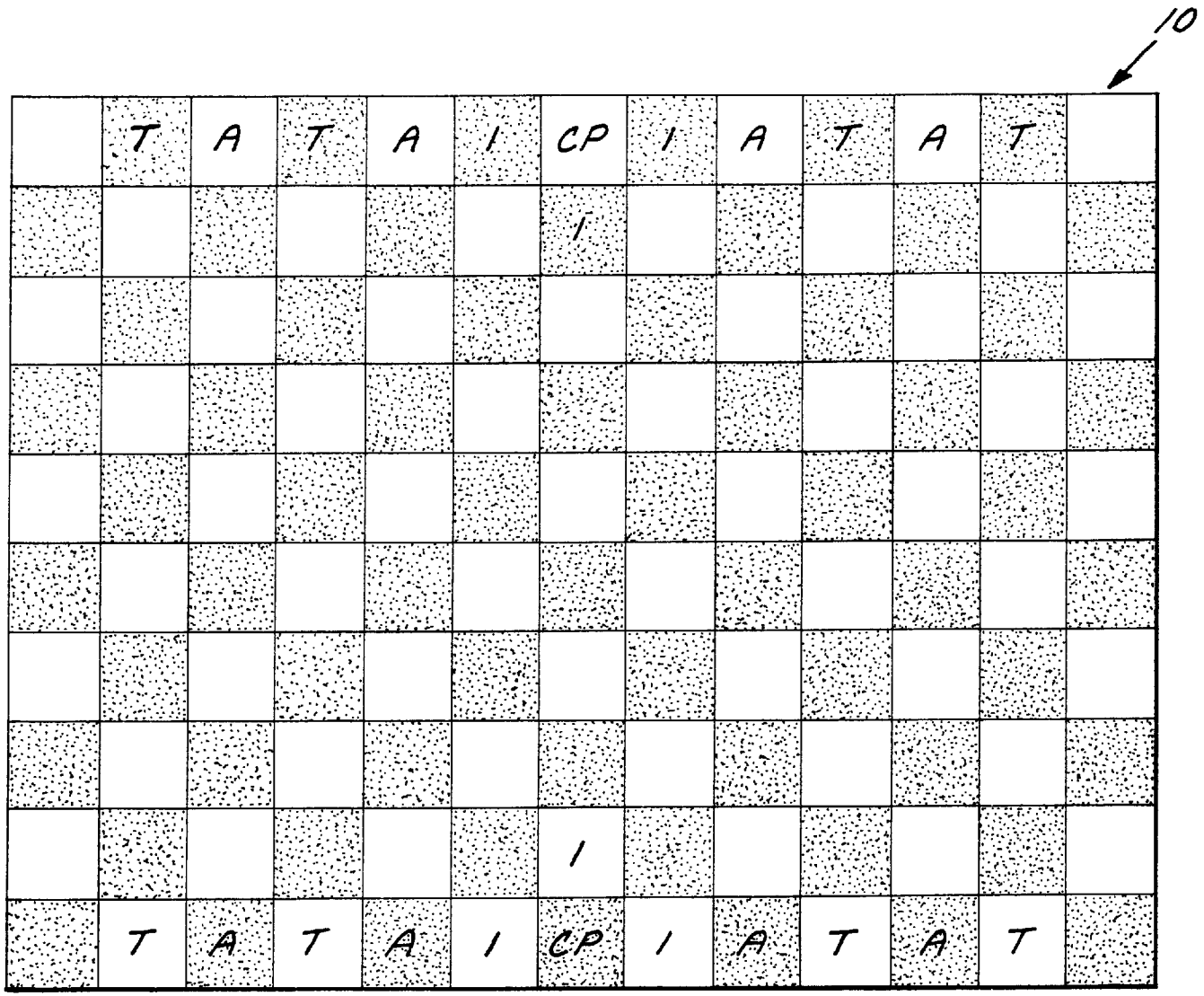
FIG. 1 is a plan view of the surface of the playing board of the present invention.

Referring to FIG. 1, a plan view of the preferred embodiment of the playing board 10 of the present invention is illustrated. The board, rectangular in shape, is ten squares long and thirteen squares wide and are alternately colored, such as yellow and white.

Figure 2:
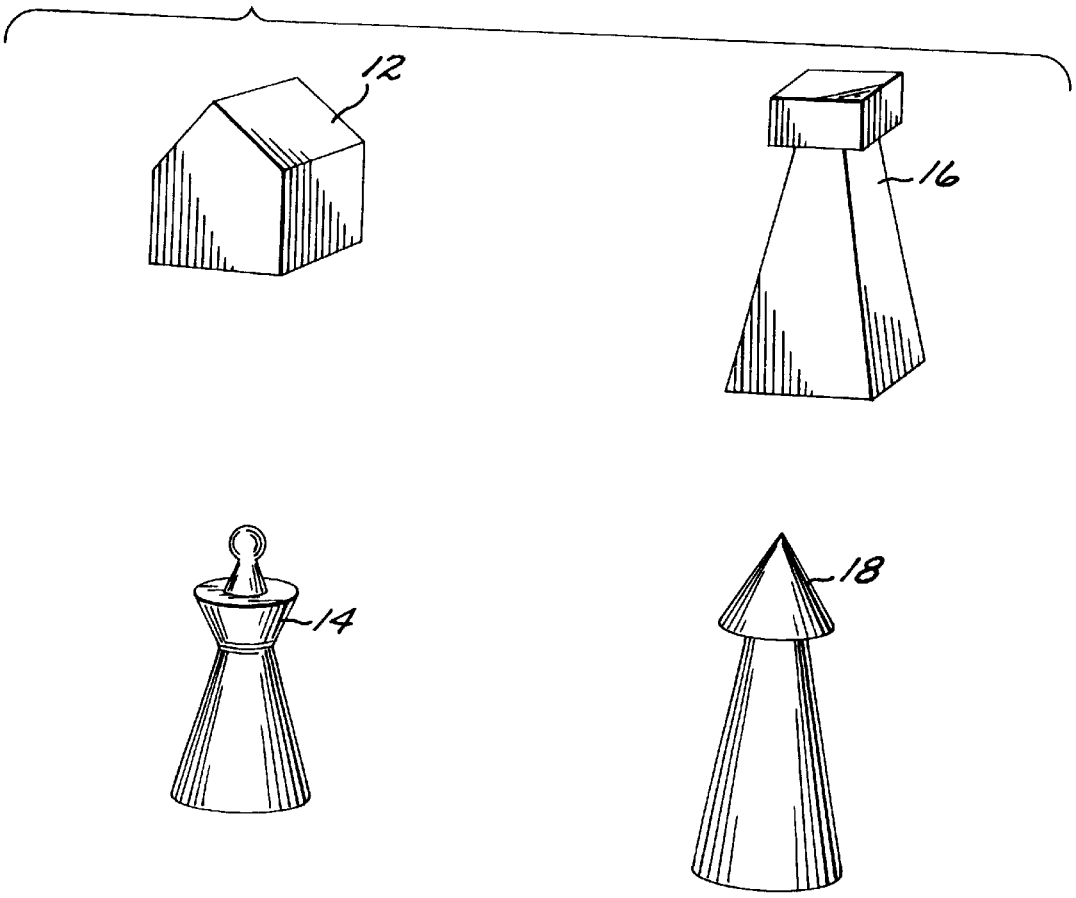
FIG. 2 is a perspective view illustrating the playing pieces utilized in the present invention.

Examples of the preferred playing pieces, or tokens, 12, 14, 16 and 18 as shown in FIG. 2. In accordance with the concept of combining the skill features of chess with military maneuvers, piece 12 is designated a command post ("CP"), piece 14 an infantry battalion ("I"), piece 16 a tank battalion ("T") and piece 18 an armored battalion ("A"). These symbols are positioned on board 10 in the starting positions shown in FIG. 1, each player (2) having twelve playing pieces, one CP, three I's, four T's, and four A's.

These pieces are colored red and black to distinguish between the armies of each player. Other colors may be used, but the board squares should be colored differently than the tokens. Also, board squares preferably have subdued colors while the tokens preferably should have dark colors for contrast.

The object of the game is for each player to capture the enemy's CP of the other player. Captures are made by removing the enemy piece and occupying the squares on which it was standing, similar to the same method used in chess.

The CP token remains in the start position on the board throughout the game and it cannot be moved to escape from being captured. The movements that the other pieces can make during a player's turn are as follows:

Infantry Battalion

It can be moved one square at a time in all directions.

Tank Battalion

Its maximum movement is limited to two squares during a turn of play and it cannot move diagonally. Examples of the movement it can make are the following:

(a) It can be moved one square forward or backward and one square sideways, for a total of two squares.

(b) It can be moved one or two squares forward, backward, or sideways.

Armored Battalion

It can be moved from one to five squares straight in all directions; forward, backward, sideways, and diagonally. It can make the same moves a "Queen" can make in chess except its maximum movement is limited to five squares at any turn of play.

Players can move their pieces to occupy a desired square only if they have a clear path to that square. None of the pieces can jump over another piece.

Figure 3:
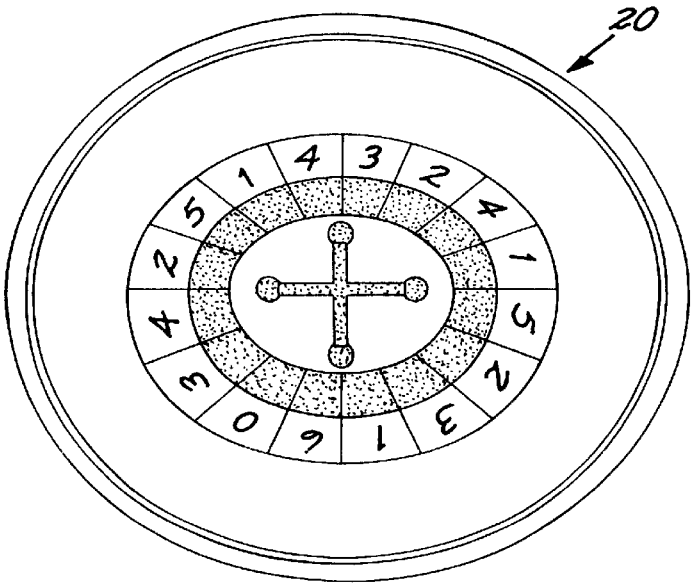
FIG. 3 is a perspective view of a spinning device used in the present invention.

The movement of the army battalion pieces by a player is determined by spinning device 20, shown in FIG. 3, similar to a roulette wheel, that has sixteen compartments that can hold a small ball. Each compartment has a number from "0" to "6" and the compartment that the rolling ball rests in is the number of squares a player can move to at a turn of play. Players are allowed one spin of the wheel that forms part of spinning device 20 during their turn of play and many move more than one token at a turn of play. As an example, if the ball rests in a compartment with a number "three", the player may move one piece three squares, three different pieces one square each, or one piece two squares and another piece one square.

Players must move their battalion pieces to the maximum number permitted by the spin of the wheel. However, if a ball rests in a compartment with the number "five" and a player has tokens on the board that can be moved to three squares, (i.e., the player has a Tank and an Infantry Battalion), then the player is limited to a three square move. In addition, if a player in this situation moves his Tank Battalion one square to capture an enemy token, then the player is limited to only a two square move for the other token.

A battalion piece cannot occupy a square twice while being moved. It must occupy a different square each time that it is moved.

When a token captures an enemy token it cannot be moved from the square that was occupied by the enemy token. A player must wait for his or her next turn of play to move it from that square, even though the player may still have additional moves to make.

To start the game, each player spins the wheel and the player who spins the highest number moves first.

While the invention has been described with a reference to its preferred embodiment, it will be understood by those skilled in the art that various changes may be made and equivalents may be substituted for elements thereof without departing from the true spirit and scope of the invention. In addition, modifications may be made to adapt a particular situation or material to the teachings of the invention without departing from its essential teachings.

What is claimed is:

1. A method of playing a board game, the board game having a playing board and a playing area comprising the steps of;

dividing said playing area into a plurality of squares of alternating color;

placing a plurality of playing pieces initially in predetermined ones of said squares for a first and second player, the game's pieces of said first and second player comprising four separate categories, the first category comprising one playing piece, the second category comprising three playing pieces, the third category comprising four playing pieces and the fourth category comprising four playing pieces, the position of said pieces for said first and second player being initially a mirror image;

moving the pieces of said first and second player in a predetermined sequence, more than one piece being movable by each player in a turn of play, a first piece of said first player occupying a first square of said playing board throughout the game, a second piece of said second player occupying a second square of said playing board throughout the game; and operating a device to determine the number of total squares the pieces are to be moved in each turn of play, said first player winning the game if one of that player's pieces occupies said second square before one of said other player's pieces occupies said first square.

2. The method of claim 1 wherein the game's pieces of said first player are of a color different than the color of the game's pieces of the second player, the color of the game pieces being different than said board squares.

3. The method of claim 1 wherein the pieces comprising said second category are movable a maximum of one square at a time in all directions.

4. The method of claim 3 wherein the pieces comprising said third category are movable a maximum of two squares at a time in all directions except diagonally.

5. The method of claim 4 wherein the pieces comprising said fourth category are movable a maximum of five squares in all directions.

6. The method of claim 5 wherein a piece of said first player positioned on a first square is removed from said game board if the movement of a piece of said second player directly lands on said first square.

* * * * *